US009646586B2

(12) United States Patent
Shirai

(10) Patent No.: US 9,646,586 B2
(45) Date of Patent: May 9, 2017

(54) ANALOG MIXER APPARATUS

(71) Applicant: Yamaha Corporation, Hamamatsu-shi, Shizuoka-ken (JP)

(72) Inventor: Mizuyuki Shirai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/334,054

(22) Filed: Jul. 17, 2014

(65) Prior Publication Data

US 2014/0328503 A1 Nov. 6, 2014

Related U.S. Application Data

(63) Continuation of application No. PCT/JP2013/050054, filed on Jan. 8, 2013.

(30) Foreign Application Priority Data

Jan. 17, 2012 (JP) ..... 2012-007560

(51) Int. Cl.

| | |
|---|---|
| ***G10H 1/00*** | (2006.01) |
| ***G10H 1/46*** | (2006.01) |
| ***H04S 5/00*** | (2006.01) |
| ***H04R 5/04*** | (2006.01) |
| ***H04S 7/00*** | (2006.01) |

(52) U.S. Cl.

CPC ..... *G10H 1/0008* (2013.01); *G10H 1/0091* (2013.01); *G10H 1/46* (2013.01); *H04R 5/04* (2013.01); *H04S 5/00* (2013.01); *H04S 7/30* (2013.01)

(58) Field of Classification Search

None

See application file for complete search history.

(56) References Cited

U.S. PATENT DOCUMENTS

| | | | | |
|---|---|---|---|---|
| 6,259,957 | B1 | 7/2001 | Alexander et al. | |
| 2007/0263884 | A1* | 11/2007 | Bedingfield | H04S 7/00 381/119 |
| 2008/0008335 | A1* | 1/2008 | Mate | G10H 3/187 381/104 |

(Continued)

FOREIGN PATENT DOCUMENTS

| | | |
|---|---|---|
| JP | H6-48221 U | 6/1994 |
| JP | 2001-196867 A | 7/2001 |

(Continued)

OTHER PUBLICATIONS

Extended European Search Report mailed Apr. 28, 2015, for EP Application No. 13738419.4, six pages.

(Continued)

*Primary Examiner* — Alexander Jamal
*Assistant Examiner* — Kenny Truong
(74) *Attorney, Agent, or Firm* — Morrison & Foerster LLP

(57) ABSTRACT

To a first analog signal that has been inputted, a first channel effect is added by an analog process that can be controlled with controls provided in a first channel strip. To a second analog signal that has been inputted, a second channel effect is added by a digital process, the second channel effect being controlled by a fourth control provided in a second channel strip. The second channel effect is preferably performed by a digital effect DSP.

3 Claims, 4 Drawing Sheets

BLOCK DIAGRAM OF MIXING PROCESSING IN MIXER APPARATUS

(56) References Cited

U.S. PATENT DOCUMENTS

2010/0309153 A1* 12/2010 Terada ..... H04H 60/04
345/173

FOREIGN PATENT DOCUMENTS

| | | | |
|---|---|---|---|
| JP | 2004-104569 | A | 4/2004 |
| JP | 2004-112413 | A | 4/2004 |
| JP | 2007-258780 | A | 10/2007 |
| WO | WO-2013/108647 | A1 | 7/2013 |

OTHER PUBLICATIONS

Written Opinion of the International Searching Authority of the PCT Application No. PCT/JP2013/050054, mailed Mar. 19, 2013, English translation, four pages.

International Search Report mailed Mar. 19, 2013, for PCT Application No. PCT/JP2013/050054, with English translation, four pages.

Yamaha. (2006). "Mixing Console, MG124CX, MG124C," Owner's Manual, Yamaha Corporation, with English translation, 52 pages.

* cited by examiner

DRAWING ILLUSTRATING OVERVIEWS OF MOUNTING AREAS OF RESPECTIVE ELECTRONIC CIRCUITS ON PRINTED CIRCUIT BOARD DISPOSED ON REAR SIDE OF CONTROL PANEL, AND CORRESPONDENCE BETWEEN THE MOUNTING AREAS AND KNOBS AND SWITCHES

DETAILED STRUCTURE OF DIGITAL CIRCUIT BOARD ON WHICH DIGITAL CIRCUIT BLOCK IS MOUNTED

ANALOG MIXER APPARATUS

CROSS-REFERENCE TO RELATED APPLICATIONS

This application is a continuation of International Application No. PCT/JP2013/050054, filed Jan. 8, 2013, which claims the priority benefit of Japanese Patent Application No. 2012-007560 filed Jan. 17, 2012, the contents of which are hereby incorporated by reference in their entireties for all intended purposes.

TECHNICAL FIELD

The invention relates to an analog mixer apparatus, and more particularly relates to an analog mixer apparatus in which signal processing related to a part of channel strips of the mixer is performed by an analog circuit, and signal processing using both an analog circuit and a digital circuit is performed in another part of channel strips.

BACKGROUND ART

An analog mixer incorporating a digital effector has been conventionally known (for example, see NPL1). The analog mixer has plural analog input channels (ch), and each analog input channel has plural analog circuit blocks such as a compressor circuit, an equalizer circuit, a fader circuit, and an output circuit. Each of analog signals inputted to each analog input channel is controlled in dynamic amplitude property by the compressor circuit, controlled in frequency property by the equalizer circuit, adjusted in static amplitude property by the fader circuit and the output circuit, and supplied to a stereo bus, a MIX bus, and an effector bus.

The stereo bus and the MIX bus each mix supplied analog signals and output the mixed analog signal to a corresponding analog output channel.

An analog signal mixed in the effector bus is converted into a digital signal by an AD converter and is inputted to a DSP (Digital Signal Processor). The DSP performs processing to add a system effect to the digital signal. The system effect refers not to an effect added to an individual signal of each channel, but to an effect added to a signal mixed on the effector bus, that is, an effect as the entire mixer. The digital signal to which the system effect is added is converted into an analog signal in a DA converter and is inputted to an effector input channel. In the effector input channel, the static amplitude property of the inputted analog signal is adjusted by the analog fader circuit, the output circuit and the like, and an analog signal after being adjusted is supplied to the stereo bus and the MIX bus.

Further, among analog mixers, there is one in which an external effector can be inserted in an input channel. This mixer is such that the external effector is inserted at a joint position between blocks of plural analog circuit blocks, an effect is added by an external effector to a signal taken out from this position, and the result is returned again to this position.

On the other hand, as a semiconductor integrated circuit used as an audio signal processing device, for example, there is known one such that a CPU, a DSP, an internal RAM, a waveform I/O, and control I/O and so on are mounted in one chip, such as that described in, for example, PTL1.

CITATION LIST

Patent Literature

{PTL1} JP 2007-258780 A

Non Patent Literature

{NPL1} "MIXING CONSOLE MG124CX INSTRUCTION MANUAL", 2006, Yamaha Corporation

SUMMARY OF INVENTION

Technical Problem

Regarding level control (control of static amplitude property) among processing in each analog input channel of the conventional analog mixer, level control by the amount of the number of buses is merely performed, leaving not much room for expansion. On the other hand, regarding adding a channel effect in every channel (control of dynamic amplitude property or frequency property), advancement and complication can be made as much as possible.

However, channel effect circuits (compressor circuit, equalizer circuit, and so on) of each analog input channel are constituted of analog circuits, and thus there has been a problem that circuits become larger in scale and actual mounting areas increase when it is attempted to add more advanced and complicated channel effects in algorithm of signal processing. Here, the more advanced and complicated channel effects are ones enabling control of the dynamic amplitude property and control of the frequency property that cannot be performed in other channels. For example, regarding the control of the dynamic amplitude property, controlling separate frequency bands in parallel may be allowed, or plural different controls may be performed sequentially. Further, regarding the control of the frequency property, the number of controlled bands may be increased, or controlling frequency or Q of part of bands may be allowed. The circuit block of an analog input channel in the analog mixer is directly connected to a control knob disposed on the corresponding channel strip of a control panel, and when a mounting area increases, there have been problems that control knobs cannot be disposed, special miniaturized parts are needed, wirings on a printed circuit board have to be thinned and routed forcibly, and the like.

Further, when the external effector is inserted in a certain input channel, if it is desired to control a channel effect added to the analog signal of this input channel by this external effector, it is necessary to operate not the channel strip of this input channel but a control panel of the external effector, which is complicated to operate.

Moreover, in the case where the channel strip of a monaural input channel and the channel strip of a stereo input channel are juxtaposed on a control panel, it is necessary in the stereo input channel to process analog signals of two channels, which are double that of the monaural input channel, and thus an analog circuit performing the same processing as the monaural input channel cannot be mounted on a circuit board having the same area, where a channel effect added in the stereo input channel is inferior to a channel effect added in the monaural input channel. Further, as a result, the channel strip of the stereo input channel tends to have less numbers of knobs and buttons disposed as compared to the channel strip of the monaural input channels.

On the other hand, in an analog mixer having a DSP, signal processing performance of DSP has improved owing to progress of semiconductor technology, and there is still a reserve capacity after performing processing of digital effect similar to conventional ones by DSP. There has been a problem that this reserve capacity is desired to be utilized for processing other than the processing of digital effector.

An object of the invention is to enable addition of channel effects which are more advanced and complicated while solving the above-described problems of mounting and to enable effective utilization of a DSP mounted for digital effector, in an analog mixer apparatus.

Solution to Problem

To attain the above object, the invention provides an analog mixer apparatus performing mixing of audio signals by analog circuits, the apparatus including: a first channel strip disposed on a control panel, a first control controlling a resistance value of a first variable resistor and a second control controlling a resistance value of a second variable resistor being disposed on the first channel strip; a second channel strip disposed on the control panel, a third control controlling a resistance value of a third variable resistor and a fourth control being disposed on the second channel strip; a first analog channel processing circuit adding a first channel effect to a first analog signal inputted from an outside in a channel effect circuit including the second variable resistor, controlling level of the first analog signal in a level control circuit including the first variable resistor, and outputting the controlled first analog signal; a second analog channel processing circuit sending a second analog signal inputted from an outside to a digital signal processing circuit, inputting the second analog signal after being processed from the digital signal processing circuit, controlling, in a level control circuit including the third variable resistor, level of the second analog signal after being processed, and outputting the controlled second analog signal; a mixing bus mixing the first analog signal from the first analog channel processing circuit and the second analog signal from the second analog channel processing circuit and outputting a mixed analog signal; and a control position detecting unit detecting an operating position of the fourth control as digital position data, the digital signal processing circuit analog/digital converting the second analog signal sent from the second analog channel processing circuit, performing processing of adding, to the converted digital signal, a second channel effect corresponding to a value of the position data of the fourth control, further digital/analog converting the processed digital signal and outputting the converted signal to the second analog channel processing circuit.

In the above analog mixer apparatus, it is preferable that the first analog signal is of monaural structure, the first analog channel processing circuit adds the first channel effect to the first analog signal of monaural structure and controlling the level of the first analog signal, the second analog signal being of stereo structure, the digital signal processing circuit adds the second channel effect to the second analog signal of stereo structure, the second analog channel processing circuit controls the level of the second analog signal to which the second channel effect is added by the digital signal processing circuit.

Further, another analog mixer apparatus of the invention is an analog mixer apparatus performing mixing of audio signals by analog circuits, the apparatus including: a first channel strip disposed on a control panel, a first control controlling a resistance value of a first variable resistor and a second control controlling a resistance value of a second variable resistor being disposed on the first channel strip; a second channel strip disposed on the control panel, a third control controlling a resistance value of a third variable resistor and a fourth control being disposed on the second channel strip; a first analog channel processing circuit adding a first channel effect to a first analog signal inputted from an outside in a channel effect circuit including the second variable resistor, controlling level of the first analog signal in a level control circuit including the first variable resistor, and outputting the controlled first analog signal to a first mixing bus and a second mixing bus; a second analog channel processing circuit sending a second analog signal inputted from an outside to a digital signal processing circuit, inputting the second analog signal after being processed from the digital signal processing circuit, controlling, in a level control circuit including the third variable resistor, level of the second analog signal after being processed, and outputting the controlled second analog signal to the first mixing bus and the second mixing bus; the first mixing bus mixing the first analog signal from the first analog channel processing circuit and the second analog signal from the second analog channel processing circuit and outputting a first analog mixed signal; the second mixing bus mixing the first analog signal from the first analog channel processing circuit, the second analog signal from the second analog channel processing circuit, and a third analog signal from the digital signal processing circuit and outputting a second analog mixed signal; and a control position detecting unit detecting an operating position of the fourth control as digital position data, the digital signal processing circuit being a digital signal processing circuit performing channel effect adding processing and system effect adding processing in a time sharing manner, the channel effect adding processing including: analog/digital converting the second analog signal sent from the second analog channel processing circuit; performing processing of adding, to the converted digital signal, a second channel effect corresponding to a value of the position data of the fourth control; further digital/analog converting the processed digital signal; and outputting the converted signal to the second analog channel processing circuit, the system effect adding processing including: analog/digital converting the first analog mixed signal inputted from the first mixing bus; performing processing of adding a system effect to the converted digital signal; further digital/analog converting the processed digital signal; and outputting the converted signal to the second mixing bus as the third analog signal.

Furthermore, in each of the above analog mixer apparatuses, it is appreciated that the second channel effect added in the digital signal processing circuit is an effect which is more complicated in algorithm of signal processing than the first channel effect.

Advantageous Effects of Invention

According to the invention, addition of a second channel effect to an inputted second analog signal is performed in digital processing, and a fourth control performing adjustment thereof is disposed on a channel strip. In this case, only the fourth control inputting a digital value needs to be disposed close to the same printed circuit board as that of a second analog channel processing circuit, and a digital signal processing circuit may be disposed on a separated position on the same printed circuit board or on another printed circuit board. Therefore, in addition to that the problems related to mounting on the printed circuit board are solved, adjustment of the second channel effect related to the second analog signal can be performed with the fourth control on the channel strip of almost the same size as a channel strip used for adjusting a channel effect in an analog circuit.

By having the second analog signal of stereo structure, a second channel effect can be added which is not inferior compared to a first effect added to a first analog signal of monaural structure.

Moreover, the digital signal processing circuit adding the second channel effect can be realized by utilizing a reserve capacity of a DSP for adding a system effect which is mounted in a conventional analog mixer, and thus can be realized by adding a few circuits (an AD converter and a DA converter for channel effect). Further, the second channel effect can be a more advanced and complicated effect than the first channel effect of analog processing.

DESCRIPTION OF EMBODIMENTS

Hereinafter, embodiments of the invention will be described using drawings.

Figure 1:
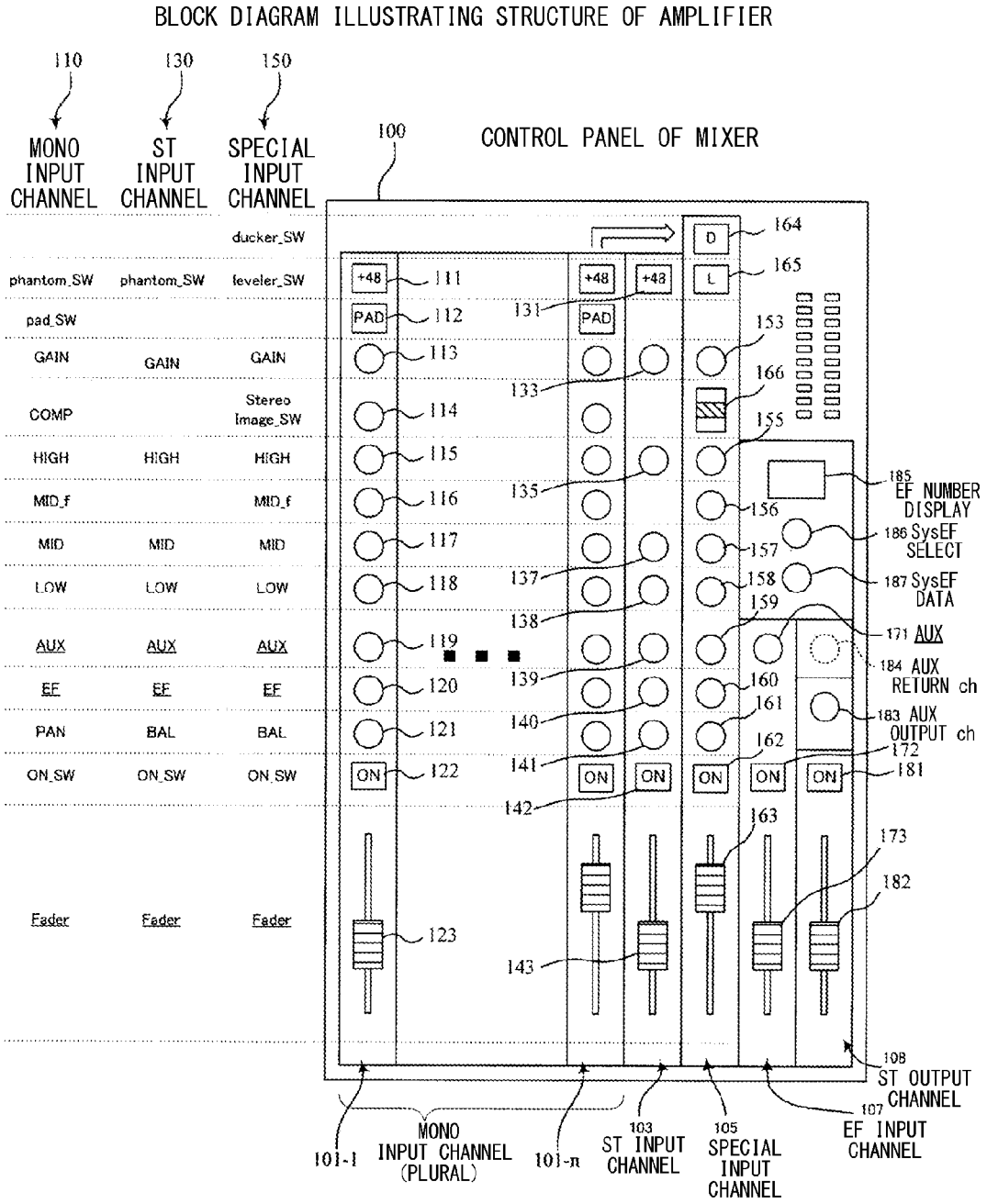
FIG. 1 is an overall structural view of a mixing system which is one embodiment to which this invention is applied.

FIG. 1 illustrates an exterior view of a control panel 100 of an analog mixer apparatus which is an embodiment to which this invention is applied.

101-1 to **101-*n* are channel strips corresponding respectively to plural (n pieces of) monaural input channels. Although not illustrated, on the control panel or a back surface of the apparatus or the like, input terminals corresponding respectively to these channel strips 101-1 to 101-*n* are provided. To each of these input terminals, one of various sound sources such as a microphone, a media player, a musical instrument, or the like can be connected. To each analog audio signal inputted via these input terminals, various adjustments corresponding to position of each control of the channel strips 101-1 to 101-*n*** corresponding to the input terminals can be performed.

Controls (denoted by 111 to 123) of the channel strip 101-1 corresponding to one monaural input channel will be described. Note that this channel strip 101-1 will be hereinafter referred to as a "Mono input channel strip 101-1". 110 denotes descriptions briefly describing functions of the controls denoted by 111 to 123 of the Mono input channel strip 101-1. These descriptions are actually written in the vicinity of the corresponding controls on the control panel, but due to an insufficient space on the diagram, they are illustrated externally on the left side (the same applies to descriptions of 130 and 150 which will be described later). Further, a control whose description of function is underlined is a control for transmission level control.

Phantom_SW 111 is a switch for turning on/off a phantom power supplied to a microphone connected to the corresponding input terminal. pad_SW 112 is a switch for turning on/off a pad function which attenuates level of a signal by a predetermined amount when a signal with large level is inputted. All of 113 to 121 denote knobs for variable resistors. GAIN 113 is a knob for gain control of a head amplifier, and COMP 114 is a knob for adjusting degree of compressor operation to compress dynamic range of an audio signal. 115 to 118 denote adjustment knobs of a three-band equalizer (EQ). In this three-band EQ, frequency range of a middle band is variable, and the frequency ranges of a high band and a low band are fixed. HIGH 115 is a knob for adjusting level of the high band, MID_f 116 is a knob for adjusting the frequency range of the middle band, MID 117 is a knob for adjusting level of the middle band, and LOW 118 is a knob for adjusting level of the low band. AUX 119 is for adjusting transmission level of a signal transmitted from this channel to an AUX bus, EF 120 is for adjusting transmission level of a signal transmitted from this channel to an effect bus (FX bus). PAN 121 is a knob for PAN adjustment adjusting what position the signal of this channel is localized to between LR of stereo. ON_SW 122 is a switch for switching valid/invalid (on/off) of signal of this channel. Fader 123 is a fader for adjusting output level of signal of this channel. In the above, the controls of the Mono input channel strip 101-1 have been described, but the other channel strips up to **101-*n*** have the same structure.

103 denotes a channel strip corresponding to a stereo input channel. Although not illustrated, on the control panel or a back surface of the apparatus or the like, terminals for inputting stereo LR signals corresponding to this channel strip 103 are provided. On stereo analog audio signals on the L side and R side inputted via the stereo input terminals, various adjustments corresponding to positions of respective controls of the channel strip 103 can be made.

Controls (denoted by 131 to 143) of the channel strip 103 corresponding to the stereo input channel will be described. Note that this channel strip 103 will be hereinafter referred to as "ST input channel strip 103". 130 denotes descriptions briefly describing respective functions of the controls denoted by 131 to 143 of the ST input channel strip 103.

Phantom_SW 131, GAIN 133, HIGH 135, MID 137, LOW 138, AUX 139, EF 140, ON_SW 142, and Fader 143 are controls serving similar functions to those of the respective corresponding controls described on the Mono input channel strip 101-1. However, the controls of the Mono input channel strip 101-1 are for controlling a monaural analog signal, but the controls of the ST input channel strip 103 are for controlling both an analog signal on the L side and an analog signal on the R side of stereo. BAL 141 is a knob for adjusting a volume balance between the L side and R side of this stereo input channel. The ST input channel does not have a compressor, and thus the control corresponding to the COMP 114 does not exist. Although EQ of the ST input channel is a three-band EQ, its frequency range of the middle band is also fixed, and thus the control corresponding to MID_f 116 does not exist.

105 denotes a channel strip corresponding to a special input channel. Although not illustrated, on the control panel or a back surface of the apparatus or the like, terminals for inputting signals (stereo LR signals) of the special input channels corresponding to this channel strip 105 are provided. Various adjustments can be made with controls of the channel strip 105 on stereo analog audio signals on the L side and R side inputted via the input terminals of the special input channels.

Controls (denoted by 153 to 166) of the channel strip 105 corresponding to the special input channel will be described. Note that this channel strip 105 will be hereinafter referred to as "special input channel strip 105". 150 denotes descriptions briefly describing respective functions of the controls denoted by 153 to 166 of the special input channel strip 105.

GAIN 153 is a gain adjusting knob of a head amplifier similar to the GAIN 133 of the ST input channel 103. In the special input channel, the analog signal after being adjusted in gain is AD converted into a digital signal, and an effect is added by digital processing (channel effect processing which will be described later). The switches denoted by 164 to 166 and knobs denoted by 155 to 158 are controls used for control of adding effect in such digital processing. Ducker_SW 164 is a switch for turning on/off a ducker, and leveler_SW 165 is a switch for turning on/off a leveler. StereoImage_SW 166 is a three-position switch, with which a stereo image is chosen. Knobs denoted by 155 to 158 are knobs for adjusting a three-band equalizer which is realized by digital processing, and is similar to the knobs denoted by 115 to 118 of the Mono input channel 101-1 in function of the control except a difference in whether internal processing is analog or digital. Channel effect processing in digital processing of them will be described in more detail later.

The digital signal after a channel effect is added in the above-described digital processing is DA converted to be returned to an analog signal again. AUX 159, EF 160, BAL 161, ON_SW 162, and Fader 163 are controls for adjusting the analog signal, and are controls serving similar functions to those of the controls denoted by 139 to 143 of the ST input channel strip 103.

107 denotes a channel strip corresponding to an effect (EF) input channel. Analog signals outputted from the above-described Mono input channel, the ST input channel, and the special input channel to an effect bus (FX bus) are mixed on the FX bus. The signal mixed on the FX bus is AD converted into a digital audio signal in a digital circuit block 270 which will be described later, and a system effect is added by digital processing (system effect processing which will be described later). The signal (stereo LR signal) to which the system effect is added is DA converted to be restored to an analog signal again and inputted internally to the EF input channel. The stereo analog audio signal on the L side and R side inputted to this EF input channel is controlled with controls of the channel strip 107. Note that this channel strip 107 will be hereinafter referred to as "EF input channel strip 107". AUX 171 is a knob for adjusting transmission level of a signal to be transmitted from this EF input channel to the AUX bus. ON_SW 172 is a switch for switching valid/invalid (on/off) of signal of this EF input channel. Fader 173 is a fader for adjusting output level of signal of this EF input channel.

108 denotes a channel strip corresponding to a stereo (ST) output channel. The stereo LR analog signals mixed on the above-described ST bus are inputted to this ST output channel. The inputted stereo analog audio signals on the L side and R side are controlled with controls of the channel strip 108. Note that this channel strip 108 will be hereinafter referred to as "ST output channel strip 108". ON_SW 181 is a switch for switching valid/invalid (on/off) of signal of this ST output channel. Fader 182 is a fader for adjusting output level of signal of this ST output channel. Output signal of the ST output channel is outputted to a stereo output terminal. The signal outputted to the output terminal is outputted as sound from a speaker via a power amplifier for example.

Other controls denoted by 183 to 187 will be described. 183 denotes a knob for adjusting level of an output signal from the above-described AUX bus. A level-adjusted signal is outputted to the outside via an output terminal for AUX. When a path to input a return signal from an external effector and transmit it to the ST bus or the AUX bus is provided, 184 denotes a control for adjusting level of signal of this path. Since there may be cases where such a path for inputting a return signal is not provided, the knob 184 is illustrated with a dashed line. 185 to 187 denote controls and a display for controlling digital processing for adding the above-described system effect. A knob 186 is for choosing type of a system effect to be added (for example, reverb, echo, chorus, or the like), and a knob 187 is for adjusting a parameter value controlling the system effect of the chosen type. A display 185 is for displaying the type of system effect chosen and the name and the current value of the parameter to be adjusted with the controls denoted by 186, 187.

Figure 2:
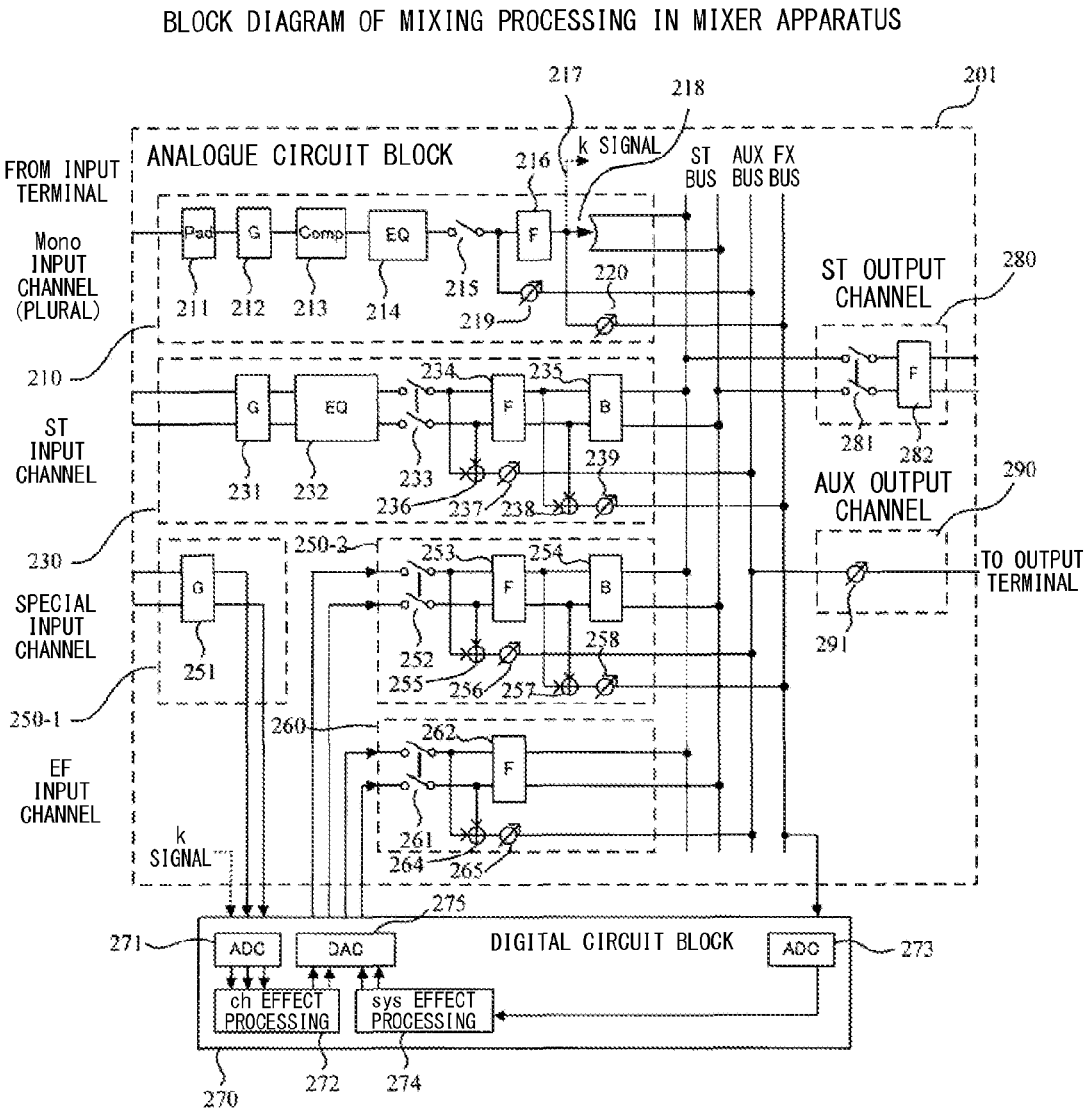
FIG. 2 is an overall diagram of an analog circuit block and a digital circuit block.

FIG. 2 is a block diagram of mixing processing of audio signals performed in this mixer apparatus. This mixing processing is constituted of an analog circuit block 201 and a digital circuit block 270. Each block in the analog circuit block 201 is mounted as an analog electronic circuit on an analog circuit board, and each block in the digital circuit block 270 is mounted as an electronic circuit on a digital circuit board or digital signal processing performed in this electronic circuit.

210 denotes a block structure of the mono input channel. Only the structure of one channel is illustrated here, but plural Mono input channels having a similar structure are provided. Note that a circuit supplying phantom power to a microphone is omitted (which are omitted similarly in 230 and 250-1 which will be described later). A monaural analog audio signal is inputted from the outside to the Mono input channel via a predetermined input terminal. 211 denotes a block realizing a pad function to attenuate the audio signal as necessary by a predetermined amount, and is turned on/off by the pad_SW 112. When a signal with too large level is inputted, the user can turn on the pad_SW 112 to attenuate the signal by a predetermined amount, making it to be an appropriate level. 212 denotes a head amplifier amplifying the audio signal. With the GAIN 113, an amplification factor (gain) by the head amplifier is controlled. 213 denotes a compressor (COMP) compressing dynamic range of the audio signal. With the COMP 114, degree of operation of the compressor (threshold and level) is controlled. 214 denotes a three-band equalizer (EQ). Level of the high band of the audio signal is controlled with the HIGH 115, frequency of the middle band thereof is controlled with the MID_f 116, level of the middle band thereof is controlled with the MID 117, and level of the low band thereof is controlled with the LOW 118. 215 denotes an on/off switch which stops supply of the audio signal from this input channel as necessary. The audio signal passes through the on/off switch 215 when the ON_SW 122 is on but does not pass through when it is off. 216 denotes a fader for level adjustment. With the fader 123, level of the audio signal passing through the fader 216 is controlled. 218 denotes a PAN adjusting unit adjusting a stereo localization position of the audio signal. With the PAN 121, balance between supply level of a monaural audio signal to an L side bus of a stereo bus (ST bus) and supply level of the same signal to an R side bus of the same is controlled. An output of the PAN adjusting unit 218 is inputted to the L side bus and the R side bus of the ST bus.

Further, an audio signal taken out from between the on/off switch 215 and the fader 216 is outputted to an auxiliary bus (AUX bus) via a level adjusting unit 219. With the AUX 119, level of the audio signal passing through the level adjusting unit 219 is controlled. An audio signal taken out from a rear stage of the fader 216 is outputted to an effect bus (FX bus) via a level adjusting unit 220. With the EF 120, level of the audio signal passing through the level adjusting unit 220 is controlled.

230 denotes a block diagram of the ST input channel. 231 denotes an amplifying unit which amplifies stereo LR analog audio signals inputted from an outside via the input terminals of the ST input channel. With the GAIN 133, an amplification factor (gain) in the amplifying unit 231 is controlled. 232 denotes a three-band equalizer (EQ). Level of the high band of the audio signals is controlled with the HIGH 135, level of the middle band thereof is controlled with the MID 137, and level of the low band thereof is controlled with the LOW 138. 233 denotes an on/off switch of audio signals of this ST input channel, through which the stereo LR analog audio signals pass when the ON_SW 142 is on or are blocked here when it is off. 234 denotes a fader for level adjustment, and level of stereo audio signals passing through the fader 234 is controlled with the Fader 143. 235 denotes a balance adjusting unit which adjusts a stereo localization position of the audio signals. With the BAL 141, level balance between a stereo L audio signal supplied from the balance adjusting unit 235 to the L side bus of the ST bus and a stereo R audio signal to be supplied to the R side bus of the same is adjusted.

Further, stereo LR audio signals taken out from between the on/off switch 233 and the fader 234 are mixed by a mixing unit 236 to be a monaural audio signal, which is outputted to the AUX bus via a level adjusting unit 237. With the AUX 139, level of an audio signal passing through the level adjusting unit 237 is controlled. Stereo LR audio signals taken out from a rear stage of the fader 234 are mixed by a mixing unit 238 to be a monaural audio signal, which is outputted to the FX bus via a level adjusting unit 239. With the EF 140, level of the audio signal passing through the level adjusting unit 239 is controlled.

250-1 and 250-2 denote block structures of a special input channel. 251 denotes an amplifying unit amplifying stereo LR analog audio signals inputted from the outside via input terminals for the special input channel. With the GAIN 153, an amplification factor (gain) in the amplifying unit 251 is controlled. Analog audio signals outputted from the amplifying unit 251 are converted into stereo LR digital audio signals in the digital circuit block 270, and a channel effect is added thereto by digital processing (channel effect processing). Digital audio signals to which a channel effect is added are converted into stereo LR analog audio signals and thereafter returned from the digital circuit block 270 to the circuit block 250-2 of the special input channel. 252 denotes an on/off switch of audio signals of the special input channel, through which the stereo LR analog audio signals pass when the ON_SW 162 is on or are blocked here when it is off. 253 denotes a fader for level adjustment, and level of stereo audio signals passing through the fader 253 is controlled with the Fader 163. 254 denotes a balance adjusting unit which adjusts a stereo localization position of the audio signals. With the BAL 161, level balance between a stereo L audio signal supplied from this balance adjusting unit 254 to the L side bus of the ST bus and a stereo R audio signal supplied to the R side bus of the same is adjusted.

Further, stereo LR audio signals taken out from between the on/off switch 252 and the fader 253 are mixed by a mixing unit 255 to be a monaural audio signal, which is outputted to the AUX bus via a level adjusting unit 256. With the AUX 159, level of an audio signal passing through the level adjusting unit 256 is controlled. Stereo LR audio signals taken out from a rear stage of the fader 253 are mixed by a mixing unit 257 to be a monaural audio signal, which is outputted to the FX bus via a level adjusting unit 258. With the EF 160, level of the audio signal passing through the level adjusting unit 258 is controlled.

260 denotes a block structure of the EF input channel. To the EF input channel, stereo LR analog audio signals after a system effect is added are inputted from the digital circuit block 270. 261 denotes an on/off switch of audio signals of this input channel, through which the audio signals pass when the ON_SW 172 is on or are blocked here when it is off. 262 denotes a fader for level adjustment, and level of stereo LR audio signals passing through this fader is controlled with the Fader 173. Stereo LR audio signals controlled in level by the fader 262 are outputted to the L side bus and the R side bus, respectively, of the ST bus. Further, stereo LR audio signals taken out from between the on/off switch 261 and the fader 262 are mixed by a mixing unit 264 to be a monaural audio signal, which is adjusted in level by a level adjusting unit 265 according to an operating position of the AUX 171 and is outputted to the AUX bus.

The digital circuit block 270 will be described. An ADC (analog/digital converter) 271 converts the stereo LR analog audio signals outputted from the amplifying unit 251 of the analog circuit block of the special input channel into stereo LR digital audio signals. Channel effect processing 272 denotes digital signal processing adding various types of channel effects to digital signals outputted from the ADC 271. Signal processing of channel effect processing 272 is controlled in its operation according to respective operating positions of the above-described controls 164 to 166 and 155 to 158, details of which will be described later with FIG. 5. Stereo LR audio signals to which a channel effect is added in the channel effect processing 272 are converted into stereo LR analog audio signals in a DAC (digital/analog converter) 275, which are outputted to the on/off switch 252 of the analog circuit block of the special input channel. An ADC 273 converts a monaural analog audio signal from the FX bus into a digital audio signal. To a monaural digital audio signal outputted from the ADC 273, a system effect is added by the system effect processing 274 which is digital processing, and stereo LR digital audio signals are outputted. This system effect processing 274 is executed based on processing algorithm (microprogram) corresponding to the type chosen with the knob 186 and plural coefficients corresponding to the type chosen with the knob 186 and the parameter set with the knob 187. The stereo LR digital audio signals outputted from the system effect processing 274 are converted into analog audio signals in a DAC 275, which are outputted to the on/off switch 261 of the EF input channel of the analog circuit block.

280 denotes a block structure of the ST output channel. To the ST output channel, stereo LR analog audio signals are inputted from the ST bus. 281 denotes an on/off switch of audio signals of the ST output channel, through which the audio signals pass when the ON_SW 181 is on or are blocked here when it is off. 282 denotes a fader for level adjustment, where the stereo LR audio signals which passed through the on/off switch 281 are controlled to be a level corresponding to position of the Fader 182 and then is outputted to the outside via stereo output terminals.

290 denotes a block structure of an AUX output channel. To the AUX output channel, a monaural analog audio signal is inputted from the AUX bus. 291 denotes a fader for level adjustment, where the inputted monaural analog audio signal is controlled to a level corresponding to position of the knob 183 and is outputted to the outside via an AUX output terminal.

Figure 3:
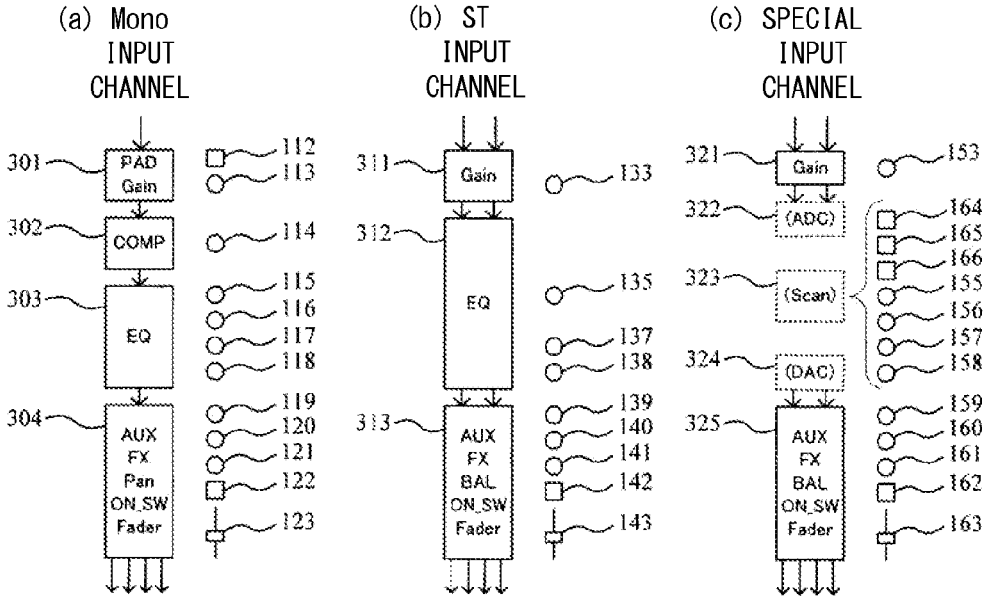
FIG. 3 illustrates an overview of mounting areas of respective circuit blocks of an input channel on a printed circuit board, and correspondence between the areas and knobs and switches.

FIG. 3 illustrates overviews of mounting areas of the electronic circuits corresponding to respective blocks of the three types of input channels on one printed circuit board (analog circuit board) disposed on a rear side of the control panel, and correspondence between the mounting areas and the knobs and the switches on the control panel. This printed circuit board is one on which the analog circuit blocks illustrated in FIG. 2 are mounted, where analog circuits of the n corresponding Mono input channels are disposed under the Mono input channel strips 101-1 to **101-*n* illustrated in FIG. 1, analog circuits of the corresponding ST input channel are disposed under the ST input channel strip 103, and analog circuits of the corresponding special input channel are disposed under the special input channel strip 105. FIG. 3 (a) illustrates an overview of mounting areas of respective circuit blocks on the printed circuit board corresponding to the Mono input channel strip 101-1, FIG. 3 (b) illustrates one likewise corresponding to the ST input channel strip 103, and FIG. 3 (c) illustrates one likewise corresponding to the special input channel strip 107. On the right side of each circuit block, the control (with the same numeral as in FIG. 1) mounted on that circuit block is illustrated. These respective analog circuit blocks are formed, on the printed circuit board, of an analog integrated circuit such as an operational amplifier, and analog parts such as transistors, capacitors, coils, diodes, and so on. Note that the phantom power supply circuit is omitted in FIG. 3**.

In the Mono input channel illustrated in FIG. 3 (a), 301 denotes a mounting range of the Pad circuit 211 and the head amplifier 212 of FIG. 2, where a Pad circuit and a head amplifier circuit including the switch 112 and the variable resistor of the knob 113, which have been described with FIG. 1, are disposed. 302 denotes a mounting range of the Comp unit 213 of FIG. 2, where a compressor circuit including the variable resistor of the knob 114 is disposed. 303 denotes a mounting range of the EQ 214 illustrated in FIG. 2, where an equalizer circuit including the variable resistors of the knobs 115 to 118 is disposed. 304 denotes a mounting range of the on/off switch 215 to the level adjusting unit 220 illustrated in FIG. 2, where send circuits to the various buses including the variable resistors of the knobs denoted by 119 to 121, the switch 122 (its main body including the knob) and the fader 123 (its main body likewise) are disposed.

In the ST input channel illustrated in FIG. 3 (b), 311 denotes a mounting range of the amplifying unit 231 illustrated in FIG. 2, where an amplifying circuit including the variable resistor of the knob 133 described with FIG. 1 is disposed. 312 denotes a mounting range of the EQ 232 illustrated in FIG. 2, where an equalizer circuit including the variable resistors of the knobs 135 to 138 is disposed. 313 denotes a mounting range of the on/off switch 233 to the level adjusting unit 239 of FIG. 2, where the variable resistors of the knobs 139 to 141 and send circuits to the various buses including the switch 142 (its main body including the knob) and the fader 143 (its main body likewise) are disposed.

The mounting range 312 of the EQ unit of the ST input channel has a larger area than the mounting range 303 of the EQ unit of the Mono input channel. This is because, in order to process stereo LR signals, circuit elements of almost double are needed compared to a circuit processing a monaural signal. On the other hand, on the control panel, if the area of the ST input channel strip is taken larger than the area of the Mono input channel strip, it is not good in an aspect of design and it may also be non-user-friendly, and thus an area of about the same size is desired. When the channel strips are given areas of about the same size on the control panel, also on the printed circuit board disposed on a rear side of the control panel, the mounting ranges of respective corresponding circuits have to be given areas of about the same size. Therefore, in the range of the circuits of the ST input channel, the circuit elements have to be mounted with high density, and it is also practiced to decrease the circuit elements by reducing functions to be less than those in the Mono input channels. In the mixer of this embodiment, this is the reason why the ST input channel has no compressor and reference frequency of the middle band of its equalizer is fixed while the Mono input channel has a compressor and its equalizer is variable in frequency range of the middle band.

In the special input channel illustrated in FIG. 3 (c), 321 denotes a mounting range of the amplifying unit 251 illustrated in FIG. 2, where an amplifying circuit including the variable resistor of the knob 153 described with FIG. 1 is disposed. 325 denotes a mounting range of the on/off switch 252 to the level adjusting unit 258 illustrated in FIG. 2, where send circuits to the various buses including the variable resistors of the knobs denoted by 159 to 161, the ON_SW 162 (its main body including the knob) and the Fader 163 (its main body likewise) are disposed. In mounting ranges 322 and 324, connectors to which cables are connected are disposed. The digital circuit block 270 illustrated in FIG. 2 is mounted on one printed circuit board (digital circuit board) separate from the analog circuit board, and to connectors of the mounting range 322, there are connected cables (including plural connection lines) which send stereo LR analog audio signals from the mounting range 321, k signals from the mounting range 304 of an n-th input channel, which will be described later, and a monaural analog audio signal from a mounting range (not illustrated) of the FX bus on the analog circuit board, to the circuit of the ADC 271 on the digital circuit board. Further, to connectors of the mounting range 324, there are connected cables which receive two pairs of stereo LR analog audio signals (to the mounting range 325 on the analog circuit board and to a mounting range of the EF input channel 260) from circuits of the DAC 275 on the digital circuit board. Note that these unidirectional two cables and the two connectors may be integrated and mounted as one cable and one connector which are bidirectional.

In 323, switches of the switches denoted by 164 to 166, the variable resistors of the knobs denoted by 155 to 158, a scan pattern (wiring) of these switches and variable resistors and a connector to which a cable is connected are disposed. This scan pattern is also connected to the variable resistors of the knobs 186, 187 for system effect disposed in a not-illustrated separate mounting range. Then, to this connector, there is connected a cable for connecting the scan pattern (wiring) to a control I/O provided in a signal processing LSI (Large Scale Integrated circuit) mounted in a digital circuit block, which will be described later. The switches of the switches denoted by 164 to 166 and the variable resistors of the knobs denoted by 155 to 158, 186 and 187 are sequentially scanned by a scan signal supplied from the LSI to the scan pattern, and consequently, state signals indicating respective states is taken into the LSI. Thus, the switches, the variable resistors, the scan pattern, and the connector are merely disposed on the rear side of the control panel, and circuit elements which perform analog signal processing for adding an effect (such as COMP and EQ of the Mono input channel) are not mounted. On the other hand, the channel effect processing in the special input channel can be performed as digital processing by using a reserve capacity of a DSP which has been utilized as a conventional digital effector, and thus addition of advanced and complicated channel effects is also possible.

Figure 4:
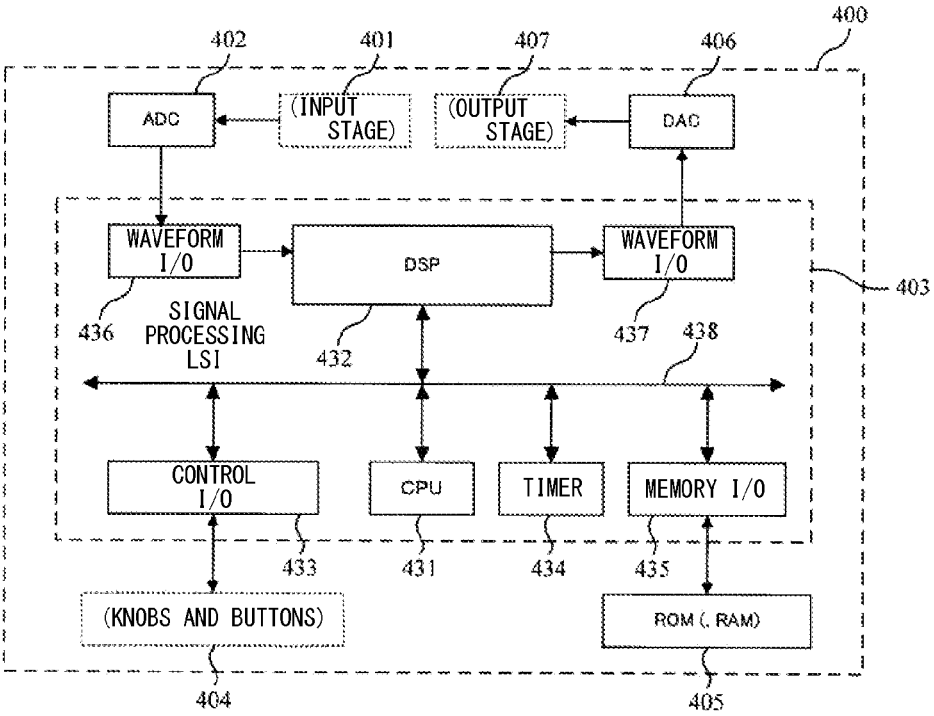
FIG. 4 is a detailed structural diagram of a digital circuit block.

FIG. 4 illustrates a detailed structure of the digital circuit board on which the digital circuit block is mounted. In this embodiment, due to an insufficient area of the printed circuit board that can be disposed on the rear side of the control panel, this digital circuit block 400 is disposed on a printed circuit board separate from the printed circuit board of the analog circuit block. However, by using a bendable flexible circuit board, or the like, part or the whole of the digital circuit block 400 may be disposed on the printed circuit board of the analog circuit block. Note that in the digital circuit block 400, processing is executed in a time sharing manner, and input/output of signals between respective channels and buses are performed at a predetermined timing of the time sharing processing.

The ADC 402 is an analog/digital converting unit including an analog/digital conversion IC (ADC integrated circuit) which realizes functions of the ADC 271, 273 illustrated in FIG. 2. Stereo LR analog audio signals from the mounting range 321 of the analog circuit board and a monaural analog audio signal from the mounting range of the FX bus are supplied to the ADC 402 via a cable connected to a connector 401, and are each converted into a digital audio signal. A DAC 406 is a digital/analog converting unit including a digital/analog converting IC (DAC integrated circuit) which realizes function of the DAC 275 illustrated in FIG. 2. Two pairs of stereo LR analog audio signals outputted from the DAC 406 are supplied to the mounting range 325 of the analog circuit board and the mounting range of the EF input channel 260 via cables connected to a connector 407. Note that these unidirectional two cables and the two connectors may be integrated and mounted as one cable and one connector which are bidirectional.

403 denotes a signal processing LSI which is a semiconductor element of one chip. In this LSI 403, a CPU 431, a DSP 432, a control I/O 433, a timer 434, a memory I/O 435, waveform I/Os 436, 437 are provided. 438 denotes a bus line connecting necessary parts of these parts with each other. The CPU 431 is a processing device controlling an overall operation of this signal processing LSI. The DSP 432 performs various types of signal processing (the channel effect processing 272 and the system effect processing 274 illustrated in FIG. 2) on digital audio signals inputted from the ADC 402 via the waveform I/O 436, and outputs signals after being processed to the DAC 406 via the waveform I/O 437. The signal processing (the channel effect processing 272 and the system effect processing 274) performed in the DSP 432 is defined according to a microprogram and a coefficient set to the DSP 432 by the CPU 431. The CPU 431 supplies, by using the control I/O 433, a scan signal which sequentially scans the switches and the variable resistors of the controls denoted by 164 to 166 and 155 to 158, and consequently, state signals indicating states of the scanned controls are outputted from the switches and the variable resistors of the controls denoted by 164 to 166 and 155 to 158 to the control I/O 433. The state signal of each control is converted into control data indicating state of the control in the control I/O 433, which are supplied to the CPU 431. Here, the control data of the switches 164 to 166 are data indicating on/off states and positions, and the control data of the knobs 155 to 158 are data indicating positions of the knobs. The CPU 431 sets plural microprograms and plural coefficients to the DSP 432 for the channel effect processing 272 and the system effect processing 274 according to the control data of the controls denoted by 164 to 166 and 155 to 158. Thus, signal processing corresponding to the control data is realized. The timer 434 is a counting device for measuring a timing of signal processing by the DSP 432 or a detection timing of state of a control by the control I/O 433. The memory I/O 435 is an interface for connecting an external memory such as a ROM (non-volatile memory) 405 and the like. The ROM 405 stores various data of programs executed by the CPU 431, microprograms and coefficients to be set to the DSP 432, and the like. In this LSI 403, a not-illustrated RAM (Random Access Memory) is also incorporated, so that the CPU 431 can execute the programs while using the internal RAM as a work area without connecting an external RAM to the memory I/O 435, and also the DSP 432 can execute signal processing of reverb or the like while using the internal RAM as a delay memory. Moreover, when an external RAM is connected as an option to the memory I/O 435, this external memory can also be utilized as a work area of the CPU 431 and a delay memory of the DSP 432.

Note that the signal processing LSI 403 is basically the same as the integrated circuit 10 disclosed in JP 2007-258780 A, and hence one should refer to this laid-open publication for more details.

Figure 5:
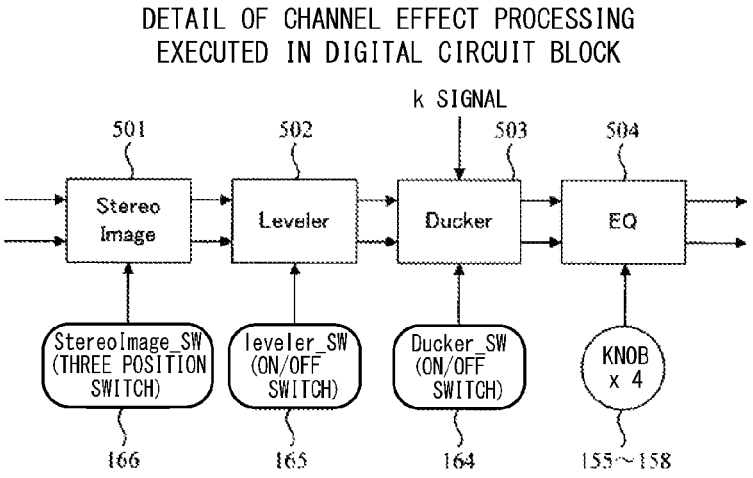
FIG. 5 is a block diagram illustrating details of channel effect processing.

FIG. 5 is a block diagram illustrating an example of the channel effect processing (272 of FIG. 2) executed in the digital circuit block. Stereo LR analog audio signals inputted from the mounting range 321 via the connector 401 are converted into stereo LR digital audio signals by the ADC 402, and are thereafter inputted to a StereoImage 501 in a first stage. The inputted audio signals are sequentially signal processed in four blocks denoted by 501 to 504, converted into stereo LR analog audio signals in the DAC 406, and thereafter outputted to the mounting range 325 via the connector 407. Note that here the number of blocks of signal processing is four, but the number of blocks may either be more or less than that. Further, processing performed in the blocks may also be different from those illustrated here.

The StereoImage 501 is processing to perform control on width of stereo sound image on the inputted stereo LR digital audio signals, according to position of the StereoImage_SW 166 which is a three position switch. When the StereoImage_SW 166 is set to a position 1 (STEREO), an inputted L-side audio signal is outputted as it is to the L side output, and an inputted R-side audio signal is outputted as it is to the R side output. When the StereoImage_SW 166 is set to a position 2 (BLEND), audio signals in which the inputted L-side audio signal and R-side audio signal are blended are outputted. That is, an audio signal in which the inputted L-side audio signal is blended more is outputted to the L-side output, and an audio signal in which the inputted R-side audio signal is blended more is outputted to the R-side output. When the StereoImage_SW 166 is set to a position 3 (MONO), an audio signal in which the inputted L-side audio signal and R-side audio signal are mixed by the same ratio and converted into a monaural signal is outputted to the L side and the R side.

The Leveler 502 is processing to attenuate, when level of the inputted stereo LR digital audio signals exceeds a predetermined threshold, volume of the input signals by a certain amount as compared to the case where the level does not exceed the threshold. This is processing for preventing level of input signals from varying in each input signal.

When the Leveler_SW 165 which turns on/off the leveler is on, this digital processing is executed, but when it is off, the input signals are outputted as they are. The processing executed includes detection of level from input signals, comparison of the detected level with the predetermined threshold, and control of rising or falling of an attenuation amount (including speed control) corresponding to a comparison result thereof. Speeds of the both are rather slow, and the processing is performed so that change of the attenuation amount takes a few seconds to a few tens of seconds. Note that in this embodiment, the attenuation amount is switched in two stages (no attenuation or a predetermined amount), but two or more thresholds and attenuation amounts may be prepared to perform switching in three or more stages.

The Ducker 503 is processing to attenuate, when level of a k signal (key signal) from the Mono input channel exceeds a predetermined threshold, the sound volume of inputted stereo LR digital audio signals by a predetermined amount compared to the case where it does not exceed the threshold and then output the signals. When the Ducker_SW 164 which turns on/off the ducker is on, this digital processing is executed, but when it is off, the input signals are outputted as they are. The k signal is an analog audio signal taken out from one predetermined Mono input channel (the n-th input channel here). In FIG. 2, the k signal is taken out at a position 217 of the Mono input channel 210 and it is inputted to the ADC 271. In the digital circuit block, the k signal is analog/digital converted in the ADC 271 and the level value thereof is obtained by digital processing, which is used for the comparison with the threshold. The processing performed in the Ducker 503 is the same as that in the leveler except that target of level detection is the k signal. However, the rising and falling speeds are higher than the Leveler, and the rising speed is higher than the falling speed. When the k signal exceeds the threshold, attenuation by the predetermined amount is performed without delay (for example, within less than one second), or when the k signal becomes lower than the threshold, the attenuation is released without delay (for example, within a few seconds).

The EQ 504 is digital processing to perform, on two digital audio signals of stereo LR, three-band EQ processing which is equivalent to that performed on one analog signal in the Mono input channel. Frequency properties are controlled with the four knobs 155 to 158. Level of the high band can be controlled with the knob (HIGH) 155, the frequency range of the middle band can be moved up and down with the knob (MID_f) 156 (the respective frequency ranges of the high band and the low band are fixed), level of the middle band can be controlled with the knob (MID) 157, and level of the low band can be controlled with the knob (LOW) 158. As compared to the EQ of the Mono input channel, internal processing differs between analog and digital, but since the knobs are the same as the knobs of the EQ of the Mono input channel, which are easy to understand for the user. As compared to the EQ of the ST input channel, since frequency range of the middle band is variable in the EQ of the special input channel, advanced and complicated processing can be realized which cannot be mounted in the EQ of analog processing in the ST input channel.

Note that the system effect processing 274 is one equivalent to digital effects which have conventionally been performed in an analog mixer apparatus, such as reverb, echo, chorus. As described above, type of the system effect is chosen with the knob 186 illustrated in FIG. 1, and a representative parameter of this system effect can be changed with the knob 187.

Figure 6:
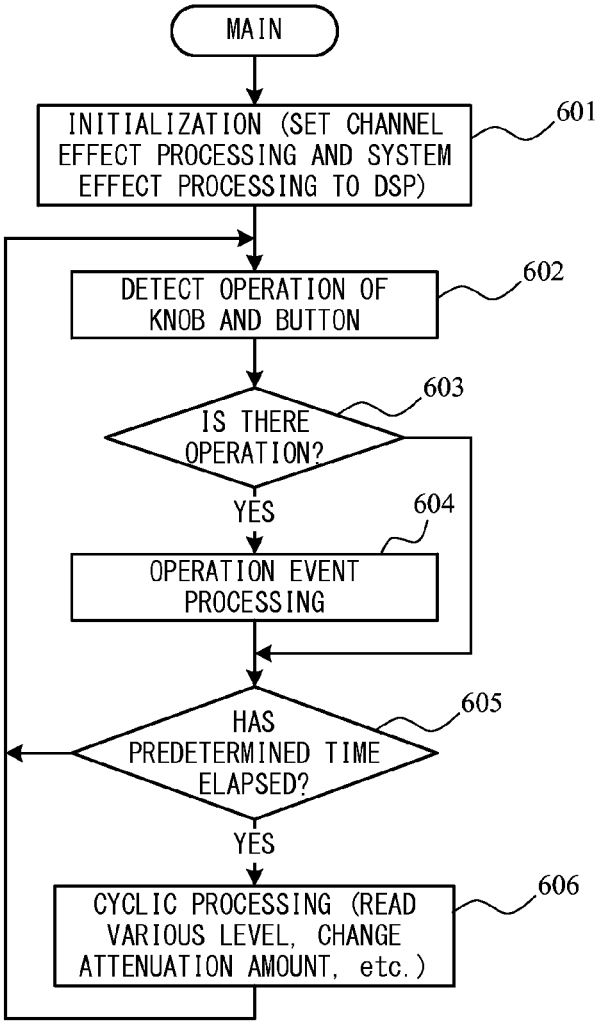
FIG. 6 is a flowchart illustrating a flow of main processing of the digital circuit block.

FIG. 6 illustrates flow of main processing of the CPU 431 of the digital circuit block. After powered on, initialization processing is performed in step 601. Here, the CPU 431 detects states of the controls denoted by 164 to 166, 155 to 158 and, according to them, initializes microprograms and coefficients for the DSP 432 to execute the channel effect processing and the system effect processing. The microprogram for the channel effect processing to be set does not depend on states of the controls but the microprogram for the system effect processing is changed according to position of the knob 186. Further, the coefficient to be set has a value corresponding to state of a control. Next, a user operation (change in state of control) of the knobs denoted by 155 to 158 and the switches denoted by 164 to 166 is detected by the control I/O 433 in step 602. When there is an operation in step 603, operation event processing corresponding to this operation is performed in step 604. This is processing for changing setting of the DSP 432 according to the detected operation. For example, according to an on/off operation of the Leveler_SW 165, execute/through of the Leveler 502 is set, and according to an increasing or decreasing operation of the knob (HIGH) 155, a coefficient value controlling level of the high band of the EQ 504 is increased or decreased. Further, according to an operation of the knob 186, microprogram and coefficient values for the system effect processing is changed, and according to an operation of the knob 187, coefficient value of a part of the system effect processing is changed. Next, whether a predetermined time has elapsed or not is determined in step 605, and when it has, cyclic processing is performed in step 606. For example, there is performed processing, for a chorus effect, to generate a low-frequency modulation waveform, and temporally change a coefficient according to the modulation waveform, processing, for a ducker or leveler effect, to read level of audio signals from the DSP 432 and change the attenuation amount according to this level, or the like.

Note that in the embodiment, one ST input channel and one special input channel are provided, but an arbitrary number of each of them may be provided. Further, the channel effect processing constituted of four blocks in the special input channel illustrated in FIG. 5 is merely an example, and can be changed freely. It is not necessary that the number of blocks is four, and advanced processing may be performed by one block or conversely may be performed by five blocks or more. As an example of the advanced processing, processing of multi-band compressor may be performed as dynamics (compressor, leveler, ducker). Alternatively, processing of equalizer with four or more bands may be performed, as an equalizer. However, since signal processing is performed after conversion into digital signals instead of processing on analog signals, it is desired to be capable of performing processing which could not be performed (cannot be mounted) on analog signals as they are.

REFERENCE SIGNS LIST

100 . . . control panel, 101-1 to **101-*n* . . . Mono input channel strip, 103 . . . ST input channel strip, 105 . . . special input channel strip, 107** . . . EF input channel strip.

The invention claimed is:

1. An analog mixer apparatus performing mixing of audio signals by analog circuits, the apparatus comprising:

a first channel strip disposed on a control panel, a first control controlling a resistance value of a first variable resistor and a second control controlling a resistance value of a second variable resistor being disposed on the first channel strip;

a second channel strip disposed on the control panel, a third control controlling a resistance value of a third variable resistor and a fourth control being disposed on the second channel strip;

a first analog channel processing circuit adding a first channel effect to a first analog signal inputted from an outside in a channel effect circuit including the second variable resistor, controlling level of the first analog signal in a level control circuit including the first variable resistor, and outputting the controlled first analog signal;

a second analog channel processing circuit sending a second analog signal inputted from an outside to a digital signal processing circuit, receiving the second analog signal after being processed from the digital signal processing circuit, controlling, in a level control circuit including the third variable resistor, level of the second analog signal after being processed, and outputting the controlled second analog signal;

a mixing bus mixing the first analog signal from the first analog channel processing circuit and the second analog signal from the second analog channel processing circuit and outputting a mixed analog signal; and a control position detecting unit detecting an operating position of the fourth control as digital position data, the digital signal processing circuit analog/digital converting the second analog signal sent from the second analog channel processing circuit, performing processing of adding, to the converted digital signal, a second channel effect corresponding to a value of the position data of the fourth control, further digital/analog converting the processed digital signal and outputting the converted signal to the second analog channel processing circuit.

2. The analog mixer apparatus according to claim 1, wherein the first analog signal being of monaural structure, the first analog channel processing circuit adding the first channel effect to the first analog signal of monaural structure and controlling the level of the first analog signal, the second analog signal being of stereo structure, the digital signal processing circuit adding the second channel effect to the second analog signal of stereo structure, the second analog channel processing circuit controlling the level of the second analog signal to which the second channel effect is added by the digital signal processing circuit.

3. An analog mixer apparatus performing mixing of audio signals by analog circuits, the apparatus comprising:

a first channel strip disposed on a control panel, a first control controlling a resistance value of a first variable resistor and a second control controlling a resistance value of a second variable resistor being disposed on the first channel strip;

a second channel strip disposed on the control panel, a third control controlling a resistance value of a third variable resistor and a fourth control being disposed on the second channel strip;

a first analog channel processing circuit adding a first channel effect to a first analog signal inputted from an outside in a channel effect circuit including the second variable resistor, controlling level of the first analog signal in a level control circuit including the first variable resistor, and outputting the controlled first analog signal to a first mixing bus and a second mixing bus;

a second analog channel processing circuit sending a second analog signal inputted from an outside to a digital signal processing circuit, receiving the second analog signal after being processed from the digital signal processing circuit, controlling, in a level control circuit including the third variable resistor, level of the second analog signal after being processed, and outputting the controlled second analog signal to the first mixing bus and the second mixing bus;

the first mixing bus mixing the first analog signal from the first analog channel processing circuit and the second analog signal from the second analog channel processing circuit and outputting a first analog mixed signal;

the second mixing bus mixing the first analog signal from the first analog channel processing circuit, the second analog signal from the second analog channel processing circuit, and a third analog signal from the digital signal processing circuit and outputting a second analog mixed signal; and a control position detecting unit detecting an operating position of the fourth control as digital position data, the digital signal processing circuit being a digital signal processing circuit performing channel effect adding processing and system effect adding processing in a time sharing manner, the channel effect adding processing comprising: analog/digital converting the second analog signal sent from the second analog channel processing circuit; performing processing of adding, to the converted digital signal, a second channel effect corresponding to a value of the position data of the fourth control; further digital/analog converting the processed digital signal; and outputting the converted signal to the second analog channel processing circuit, the system effect adding processing comprising: analog/digital converting the first analog mixed signal inputted from the first mixing bus; performing processing of adding a system effect to the converted digital signal; further digital/analog converting the processed digital signal; and outputting the converted signal to the second mixing bus as the third analog signal.

* * * * *